US005871277A

United States Patent [19]

Lash

[11] Patent Number: 5,871,277

[45] Date of Patent: Feb. 16, 1999

[54] INDUSTRIAL VIBRATOR

[76] Inventor: Richard L. Lash, 9921-K Tanner Rd., Houston, Tex. 77041

[21] Appl. No.: 869,132

[22] Filed: Jun. 4, 1997

[51] Int. Cl.[6] ..... B06B 1/18

[52] U.S. Cl. ..... 366/124

[58] Field of Search ..... 366/108, 118, 366/114, 124; 92/85 R; 91/216 R, 216 B, 217

[56] References Cited

U.S. PATENT DOCUMENTS

| | | | |
|---|---|---|---|
| D. 180,793 | 8/1957 | Lash . | |
| 1,162,562 | 11/1915 | Brown | 92/85 R |
| 2,515,110 | 7/1950 | Bornstein | 92/85 R |
| 2,884,901 | 5/1959 | Chandler et al. | 366/124 |
| 3,363,806 | 1/1968 | Blakeslee et al. | 366/114 |
| 3,731,907 | 5/1973 | Lash | 366/114 |
| 3,916,982 | 11/1975 | Blower et al. | 91/216 B |
| 3,917,233 | 11/1975 | Blower | 366/124 |
| 4,067,549 | 1/1978 | Konyak et al. | 74/579 R |
| 4,083,415 | 4/1978 | Kita et al. | 173/132 |
| 4,129,388 | 12/1978 | McKee | 366/124 |
| 4,150,922 | 4/1979 | Cuenoud et al. | 92/84 |
| 4,256,014 | 3/1981 | Kroger | 91/216 B |
| 4,288,165 | 9/1981 | Fewel | 366/124 |
| 4,588,300 | 5/1986 | Guy | 366/124 |
| 5,209,564 | 5/1993 | Manci et al. | 366/124 |

FOREIGN PATENT DOCUMENTS

| | | | |
|---|---|---|---|
| 614251 | 7/1978 | U.S.S.R. | 366/124 |

*Primary Examiner*—Tony G. Soohoo
*Attorney, Agent, or Firm*—Jo Katherine D'Ambrosio

[57] ABSTRACT

An industrial vibrator for imparting vibrations which cause the flow of bulk particulate matter. The industrial vibrator is comprised of a housing and a reciprocating piston vertically movable within the cylinder bore of the housing. The piston is driven by compressed air causing the piston to rapidly and repeatedly strike a striking plate formed by the bottom of the housing thereby imparting vibrations to a hopper or bin to initiate and maintain movement of bulk particulate material. The striking end of the piston has a threaded bore for receiving a reciprocally threaded extension of an elastomeric tip so that the elastomeric tip is fixedly attached to the piston. The elastomeric tip reduces the decibel noise level caused by the piston's repeated impacts on the striking plate to levels acceptable under industrial safety and comfort standards. The durometer rating of the elastomeric tip is between 65 and 75 to withstand the frictional heat and disintegration resulting from repeated impacts against the metal striking plate.

12 Claims, 3 Drawing Sheets

INDUSTRIAL VIBRATOR

FIELD OF THE INVENTION

The present invention relates to an industrial vibrator that produces vibrations for inducing the fluid flow of particulate bulk matter. More particularly, an industrial vibrator that combines a reciprocating piston with a durable elastomeric tip affixed to the striking end of the piston.

BACKGROUND OF THE INVENTION

Industrial vibrators are utilized to enhance fluid flow of matter not prone to act like a fluid, i.e. solid matter in small particulate form such as sand, grains or any variety of small pellets stored in bulk. Often these items are kept in large containers such as hoppers or large bins where settling often causes the bulk density of the particulate matter to increase during storage, making fluid flow difficult. Vibration to the outer surface of the container by an industrial vibrator reduces the solid matter bulk density and enables fluid-like flow. Industrial vibrators are used to improve fluid flow of the particles just prior to transferring the matter by vibrating the container, or during solid matter transfer by vibrating the outer surface of a transfer line.

Two types of pneumatic industrial vibrators are commonly used to cause the vibratory action; an impact vibrator that produces vibration by a piston impacting a striking plate and an air cushion vibrator which uses a cushion of air to separate the piston from the striking plate. When impact pneumatic vibrators are used, the action of a steel piston impacting a metal striking plate can produce noise levels that violate safety and comfort levels. Noise can contribute to worker's physical ailments such as hearing impairments, headaches, fatigue and high blood pressure. Noise levels are reduced with air cushion vibrators but so is the vibratory force. Air cushion industrial vibrators often lack the force to impart vibrations required to unwedge tightly packed particles. To overcome the problem of unacceptable noise levels in impact vibrators, elastomer has been used to muffle noise. Until the present invention, however, the type of elastomer used and the method of attachment often caused disintegration of the elastomer as a result of the heat-friction from impacts occurring at the rate of up to 1500 to 5000 vibrations per minute.

McKee, U.S. Pat. No. 4,129,388 discloses a reciprocating pneumatic piston vibrator having an elastomer that prevents the piston end from directly striking the impact end of the piston chamber. McKee '388 discloses that the resilient elastomer material is adapted to be mounted between the base closed end of the cylinder and the piston end for the purpose of absorbing the noise of impact. The elastomer material may be on either impact surface, attached to the piston or the piston cylinder end. McKee '388 also discloses a piston wholly constructed of elastomer.

Blower, U.S. Pat. No. 3,917,233 discloses a pneumatic vibrator for foundry molding machines having a cylindrical striker insert fitted within a recess of an end cap. The striker insert is made of material having very low sound transmitting characteristics such as urethane, rubber or similar materials. It further discloses a striker insert made of urethane rubber having a durometer hardness around 80 to 100. This striker insert is squeezed into the recess of the end cap and may be secured in the recess by mechanical fastener means or adhesive.

Fewel, U.S. Pat. No. 4,288,165 discloses a vibratory actuator used in vibrator machines. The vibratory actuator combines the functions of a hydrodynamic journal bearing and an eccentrically weighted shaft into a single assembly. In one embodiment of this invention, the base and frame of the machine include a base supporting a frame interconnected by springs. The springs may be coil springs or elastomeric springs.

References providing general background interest consist of Lash, U.S. Pat. No. 3,731,907 which discloses a vibrator system with a sleeve member containing a tapered bore for positioning upon another tapered bore affixed to the surface that is to be vibrated, thus eliminating mounting bolts. Blakeslee et.al., U.S. Pat. No. 3,363,806 discloses a vibrator for bins or receptacles which employs a hydraulic actuating means. Blakeslee et.al. '806 also discloses a timing means for actuating the vibrator at timed intervals. Lash, U.S. Pat. No. Des. 189,793 discloses a design for a storage hopper. Konyak et. al., U.S. Pat. No. 4,067,549 disclose a ceramic rapper rod assembly for electrostatic precipitators for use in high temperature environments. Kita et. al., U.S. Pat. No. 4,083,415 disclose an impact bit for down hole operations comprising a body adapted for being chucked into an impact motor.

Prior to the present invention, the longevity of elastomers used with elastomeric-tipped pistons was limited. The elastomer often disintegrated as a result of the stress and frictional heat caused by a reciprocal steel piston impacting a metal striking plate at a rate of 1500 to 5000 times per minute. The method of attachment of the elastomer to the striking end of the piston also contributed to limited longevity of the elastomer. The known methods of attachment were not be able to withstand the stresses of rapidly repeated impacts and thereby required frequent replacements.

What is desired is a rubber or elastomer tip on the striking bottom of the piston within an industrial vibrator that reduces noise levels to acceptable decibels. It is also desired to have an elastomer with a durometer rating that enables it to withstand frictional heat and wear of 1500 to 5000 impacts per minute. Also necessary is a method of attachment of the elastomer to the piston that will not loosen upon repeated impacts.

SUMMARY OF THE INVENTION

The industrial vibrator of this invention comprises an elastomeric-tipped piston resulting in reduced noise levels. Preferably the elastomer has a durometer rating of 65 to 75 to withstand frictional heat caused by vibrations occuring at 1500 to 5000 cycles per minute without suffering excess material degradation. Preferrably, the elastomeric-tip is firmly attached to the piston by a threaded screw to prevent loss of the elastomer during operation of the vibrator.

DETAILED DESCRIPTION OF THE INVENTION

Figure 1:
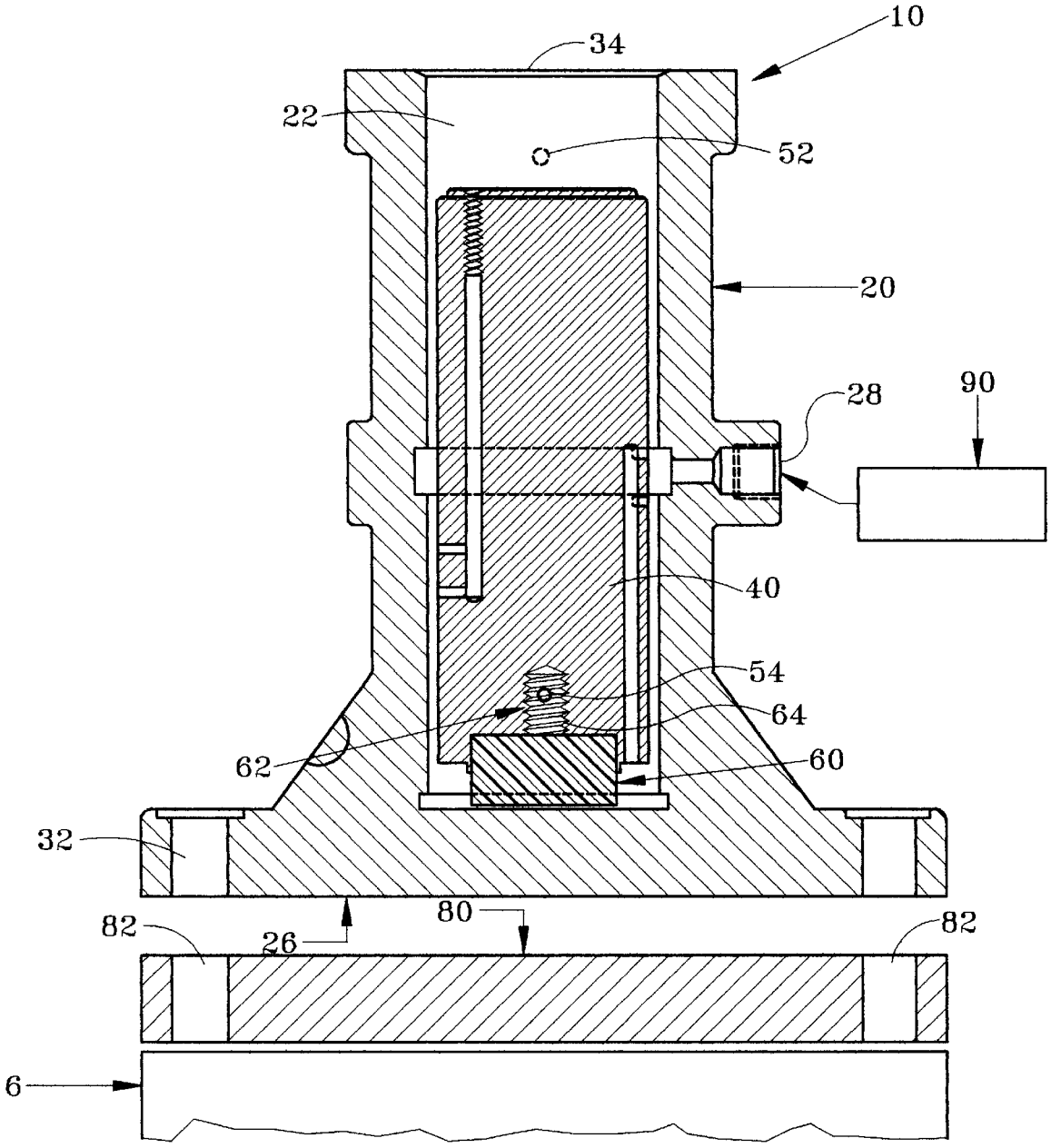
FIG. 1 illustrates a cross-section of the industrial vibrator of this invention.

Referring now to the drawings in which like parts are referenced by like numerals, FIG. 1 illustrates a cross sectional view of the industrial vibrator 10 of the kind used to impart vibrations which cause movement of bulk particulate matter. The industrial vibrator 10 is comprised of a housing 20 having a cylinder bore 22 formed within the housing 20 to receive a reciprocating piston 40. The reciprocating piston 40 is vertically movable within the cylinder bore 22. The bottom of the housing 20 forms a striking plate 26 that is impacted by the piston 40 during the operation of the vibrator 10. The striking end of the piston 40*a* has a threaded bore for receiving a reciprocally threaded extension of an elastomeric tip 60 used to reduce the decibel level caused by the steel piston impacting the metal striking plate. Preferably, the elastomeric tip 60 has a durometer rating between 65 and 75 for durability. Preferably, the piston 40 is driven by compressed air which causes the piston 40 to rapidly and repeatedly strike the striking plate 26 thereby imparting vibrations to a hopper 86 to initiate and maintain movement of bulk particulate material.

Figure 3:
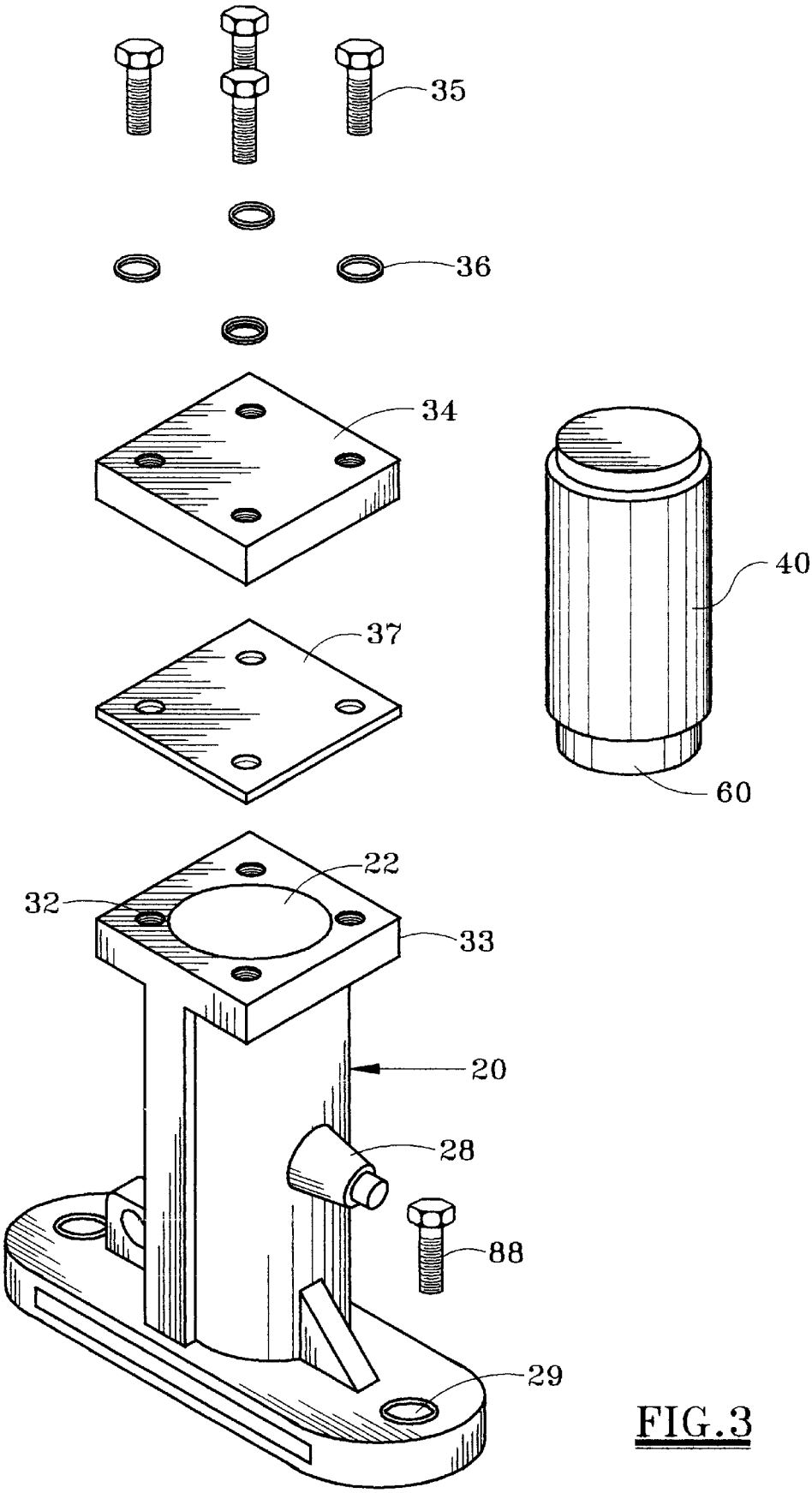
FIG. 3 is a perspective view of one embodiment of this invention.

Preferably, the cylinder bore 22 is sealed at the top of the housing 33 by a head plate 34 mounted to the housing 20 by head bolts 35 attached to bolt holes 32 formed in the top of the housing 33. As shown in FIG. 3, a gasket 37 can be positioned between the head plate 34 and the top of the housing 33 to provide a seal against pneumatic leaks between the head plate 34 and the housing top 33. In a preferred embodiment of this invention, the head plate 34, is rectangular and has the same lower surface dimensions and number of bolt holes as the housing top 33. The top mounting bolt holes 32 are formed onto the housing top 33 in axial alignment with the bolt holes formed onto the head plate 34. The top mounting bolt holes 32 are preferably threaded, having threads matching those on the head bolts 35. Preferably, the head bolts 35 are provided with lock washers 36 fabricated to slidingly fit over the threaded portion of the head bolts 35 and provide axial tension onto the head bolts 35 after the head bolts 35 are tensioned into place.

The bottom of the housing 20 forms the striking plate 26 which receives the impact of the piston 40 during operation of the vibrator 10. Mounting bolt holes 29 are located in the ends of the striking plate 26. Bolts 88 can be threaded through the mounting bolt holes 29 to secure the industrial vibrator 10 to the object to be vibrated (hopper 86). The bolts 88 are further threaded through plate bore holes 82 in a mounting plate 80 to attach the housing 20 to the mounting plate 80. The mounting plate 80 is mounted onto an outer wall of the hopper 86 to which the industrial vibrator 10 imparts vibrational forces. In one preferred embodiment, the mounting plate 80 is welded to the hopper 86. Alternatively, the mounting plate can be bolted to the hopper. The preferred material for the housing 20 is ductile iron or any material that reacts like steel but has porosity for the flow of frictional lubricants within the cylinder bore 22. The preferred material for the piston 20 is a steel alloy or any metal having similar stress-proof properties of steel.

A pneumatic air inlet 28 is located in a wall of the housing 20*a*. The preferred size of the air inlet 28 is 0.25 in. NPT. A pneumatic air inlet 28 is threaded for connecting to a high pressure pneumatic supply (not shown) and provides fluid communication between the pneumatic supply source 90 and the cylinder bore 22. A preferred pneumatic source is a compressor supplying compressed air. Preferably, the compressed air is supplied to the industrial vibrator 10 at air pressures that range from 40 psi to 80 psi.

An annulus 28*a* is radially formed along the inner wall of the cylinder bore 22 where the cylinder bore 22 mates with the pneumatic air inlet 28. The annulus 28*a* has a radius greater than the cylinder bore 22. The preferred configuration of the cylinder bore 22 and the piston 40 is cylindrical. Preferably, the length of the cylinder bore 22 is of sufficiently greater length than the piston 40 so as to provide a head space for the compressed gas.

Figure 2:
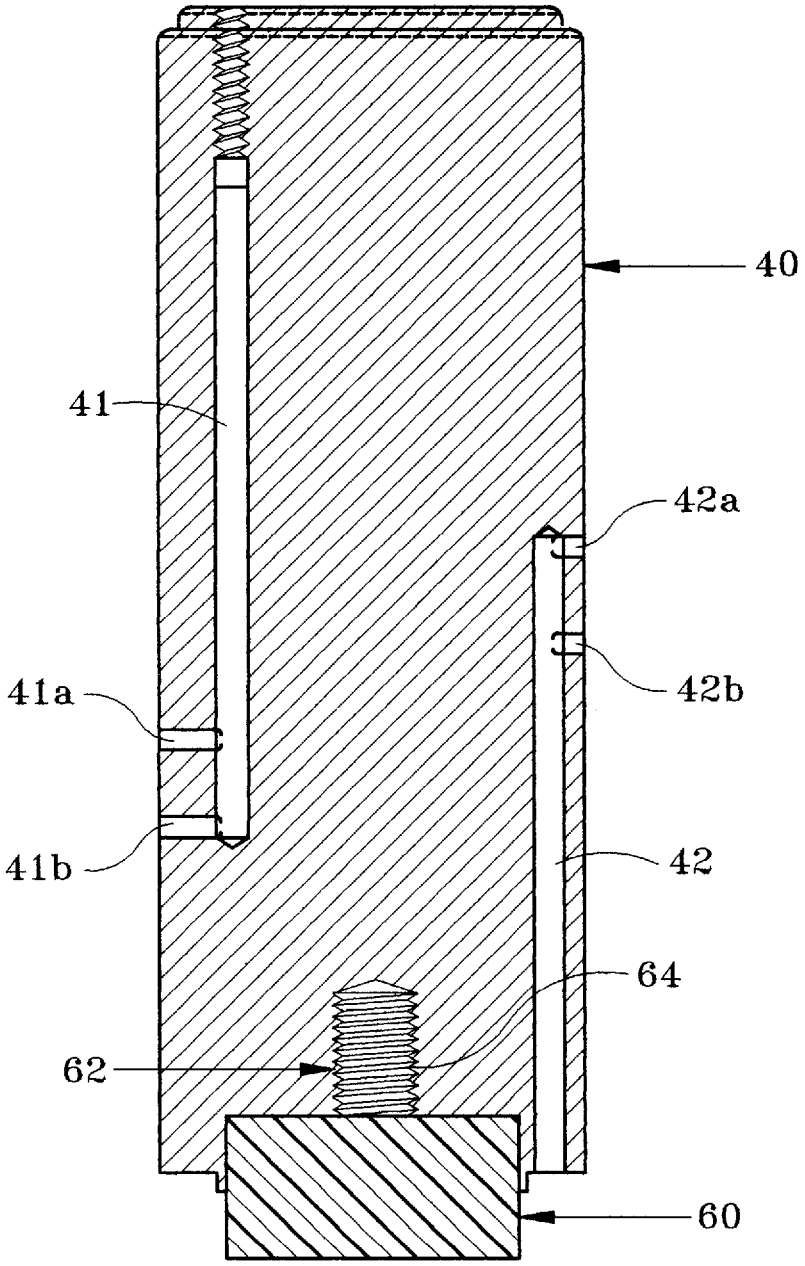
FIG. 2 is an enlarged cross section of the piston of this invention.

Referring to FIG. 1 and FIG. 2, the piston 40, has preferably two axially formed channels 41, 42 therein. Preferably, the first channel 41 is formed to extend downward from the top of the piston 40 and the second channel 42 is formed to extend from the bottom of the piston 40. For each axially formed channel 41, 42 there are preferably two radial cavities, 41*a*, 41*b* and 42*a*, 42*b*. Radial cavities 41*a* and 41*b* are formed from the outer radius of the piston 40 and traverse radially inward and connect to the first axial channel 41. Radial cavities 42*a* and 42*b* are formed from the outer radius of the piston 40 and traverse radially inward and connect to the second axial channel 42. Two exhaust ports 52, 54, a top exhaust port 52 and a bottom exhaust port 54, are located in the housing wall 20*a* positioned in reference to the piston 40 where indicated on FIG. 1 by dotted circles 52 and 54.

Attached to the bottom of the piston 40 is an elastomeric tip 60, preferably cylindrical and having a preferred length of one (1) inch. The elastomeric tip 60 is preferably comprised of elastomer having a durometer rating of 65 to 75. More preferably the elastomer has a durometer rating of 70. Preferably, the elastomer is comprised of synthetic rubber. Elastomeric tips are known to those skilled in the art and commonly available. However, elastomeric tips with specific durometer ratings between 65 and 75 are custom made to specification by manufacturers such as Enterprise Rubber Inc. in Akron, Ohio.

Preferrably, the elastomeric tip 60 has a treaded extension 64 formed on one end of the elastomeric tip. The treaded extension 64 is preferrably metal. The bottom of the piston forms a threaded recess 62 to receive the threaded extension 64, the threads of the extension are preferably formed to mate with threads formed on the recessed area inside the bottom of the piston 62. The elastomeric tip 60 is fixedly attached to the piston 40 by screwing the threaded extension 64 into the threaded recess 62."

When using the industrial vibrator 10 of this invention to fluidize particles stored inside a tank or hopper 86, the industrial vibrator is first securely mounted onto the tank or hopper 86 and compressed air is supplied to it through the pneumatic air inlet 28 from a high pressure air source 90. The compressed air cycles the piston 40 up and down within the cylinder bore 22. The pressurized air is allowed to fill the annulus 28*a* and then passes through the radial cavities 42*a* and 42*b*. Immediately prior to the pressurized air entering the radial cavities 42*a* and 42*b*, the piston 40 is in a down position adjacent the striking plate 26. The bottom exhaust hole 54 is covered by the piston so that a compression chamber 23 is formed as compressed air moves from the axial channel 42 to the bottom of the piston 40, thereby forcing the piston 40 upwards. The upward motion of the piston 40 removes the piston 40 from the bottom exhaust hole 54. This in turn allows the pressurized air flow to escape through the bottom exhaust hole 54 terminating the pressurized air force motivating the piston 40 upwards. Before the piston 40 stops at a point adjacent the head plate 34, the first radial ports 41*a* and 41*b* become in communication with the annulus 28*a*, allowing pressurized air flow into the axial channel 41 that pressurizes the space above the piston 40 thereby forming a second compression chamber 38 above the piston 40. Since the pressure above the piston 40 is now greater than the pressure below the piston 40, the piston 40 is forced downward, and the piston 40 impacts the striking plate 26. The elastomeric tip 60 prevents the steel piston from directly impacting the striking plate there by reducing the decibel level to a range acceptable to industry safety standards and comfort of the user, i.e. a range of approximately 86 dBA to 95 dBA.

The impact of the elastomeric-tipped piston 40 against the striking plate 26 is translated into a force that propagates through the striking plate 26 and mounting plate 80 onto the tank or hopper 86 surface where the industrial vibrator 10 is attached an ultimately throughout the particles stored in the tank or hopper 86. It is this force that loosens the particles held in the tank or hopper 86 and fluidizes them, thus allowing for pseudo-fluid flow of the particles. As long as pressurized air is provided to the industrial vibrator 10 the cycle of upward and downward motion of the piston 40 continues. The frequency can range from 1500 cycles per minute to 5000 cycles or more per minute, and the force imparted onto the striking plate can vary from 200 pounds to 800 pounds or more. The amplitude and frequency of the vibration produced by the reciprocating piston 40 is in direct proportion to the air pressure of the compressed air supplied to the housing 20. The preferred air pressure is within an approximate range of 40 psi to 90 psi. For example frequencies greater than 100 psi are too fast, causing the piston 40 to lose amplitude of force.

EXAMPLE

Test procedures relating to the industrial vibrator 10 were performed. The industrial vibrator 10 was operated and frequency of the vibrator 10 (C.P.M), the force of impact (lbs) and the resulting noise level (dB) were recorded. The tests were performed using a piston tip 62 comprised of steel, and a piston tip 62 comprised of synthetic rubber having a durometer rating of 70. The air volume was measured with a Dwyer Model #122 having a range of 2–20 SCFM. The frequency was recorded with a Treysit—Sirometer having a range of 800–50,000 RPM, the frequency measured was in cycles per minute (C.P.M). The noise level was recorded with an H. H. Scott type 450-B Sound level meter, having a range of 26 to 140 dB. All dB levels were recorded with the industrial vibrator 10 mounted to a 400 pound test block, and the sound level meter located 3 feet from the vibrator.

During the testing process a large range of types and sizes of rubber tips 60 were purchased and tested. Through trial and elimination many models of rubber tips 60 were eliminated, the elimination criteria were durability and mechanical characteristics. It was found that elastomer tips with durometer ratings within an approximate range of 30 to 40 melted during repeated vibration testing (approximately 3 to 4 hours of use in industrial vibrator). Elastomeric tips with with durometer ratings within an approximate range of 50 to 50 became hot and disintegrated during testing. Elastomers with durometer ratings above 75 are not manufactured for vibrator purposes because of brittleness.

Tests were taken in two parts; the first part consisted of taking the physical tests with the measurement instruments. Through this air flow (SCFM), frequency (C.P.M.) and noise levels (dB) were obtained. Test models were performed for extended periods of time, sometimes for weeks at a time. The second part of the test involved recording the test results. By analyzing the recorded data of air flow, frequency, and noise level, the force of the piston 40 was then determined using formulas derived to calculate force. After calculating the force, the recorded data was then tabulated with the corresponding force. Table 1 illustrates these values for rubber tipped pistons 40 and steel tipped pistons 40.

TABLE 1

TEST DATA

| Frequency (CPM) | Steel Tip-force (lbs) | Steel Tip-Noise (dB) | Rubber Tip-Force (lbs) | Rubber Tip-Noise (dB) |
|---|---|---|---|---|
| 1600 | n/a | n/a | 210 | 86 |
| 1800 | 245 | 107 | 266 | 88 |
| 1950 | 270 | 109 | 312 | 94 |
| 2000 | 303 | 111 | 332 | 95 |
| 2100 | 332 | 112 | 362 | 97 |
| 2200 | 369 | 113 | 397 | 97 |
| 2300 | 400 | 112 | 434 | 101 |
| 2400 | 436 | 114 | 473 | 101 |
| 2500 | 473 | 114 | 497 | 101 |
| 2600 | 512 | 114 | 521 | 102 |
| 2800 | 594 | 114 | | |

FORMULA FOR CALCULATION

FORCE = .0000284 × (UNBALANCE) × FREQUENCY 2
AMPLITUDE = UNBALANCED/TOTAL LOAD
INCHES = POUND INCHES/POUNDS
2 × STROKE × PISTON WEIGHT)/TOTAL UNIT WEIGHT = AMPLITUDE
UNBALANCE = STROKE × PISTON WEIGHT

RAW DATA FOR STEEL TIPPED PISTON

| | |
|---|---|
| STROKE IMP | 0.344 in. |
| PISTON WEIGHT IMP | 7 lb. 11 oz |
| PISTON DIA IMP | 2.24 in. |
| PISTON LENGTH IMP | 7.5 in. |
| UNBALANCE IMP | 2.666 lb.-in. |
| CU. IN. IN STROKE | 1.356 |

RAW DATA FOR RUBBER TIPPED PISTON

| | |
|---|---|
| STROKE IMP | 0.385 in. |
| PISTON WEIGHT IMP | 7.8 lb. |
| PISTON DIA IMP | 2.24 in. |
| PISTON LENGTH IMP | 7.841 in. |
| UNBALANCE IMP | 2.89 lb.-in. |
| CU. IN. IN STROKE | |

The results from Table 1 indicate that a rubber tipped piston, having a durometer rating of 65–75, more preferably 70, produced less noise (dB) than the steel tipped piston under otherwise identical conditions. More significant, and more surprising, is that the rubber tipped piston provided a larger force onto the strike plate 26 than a steel tipped plate at the same frequency of impact. This resulted in a quieter operation.

The foregoing description is illustrative and explanatory of preferred embodiments of the invention, and variations in the size, shape, materials and other details will become apparent to those skilled in the art. It is intended that all such variations and modifications which fall within the scope or spirit of the appended claims be embraced thereby.

I claim:

1. An industrial vibrator for imparting vibrations to cause the flow of bulk particulate matter comprising:

a housing comprising cylindrical walls and a striking plate closing off one end of the housing, the walls of the housing defining a cylindrical bore;

a reciprocal piston within the cylindrical bore for imparting a vibrating force to the striking plate, the piston comprising a striking end; and an elastomeric tip threaded into the striking end of the piston.

2. The industrial vibrator according to claim 1 wherein the elastomeric tip has a durometer rating between 65 and 75.

3. The industrial vibrator according to claim 1 wherein the elastomeric tip comprises a durometer rating of 70.

4. The industrial vibrator according to claim 1 wherein the elastomeric tip comprises rubber.

5. The industrial vibrator according to claim 1 wherein the elastomeric tip comprises a treaded extension and the striking end of the piston defines a bore reciprocally threaded to receive the threaded extension.

6. The industrial vibrator according to claim 1 wherein the housing comprises a pneumatic air inlet for receiving compressed air from a compressed air source, the housing defining a first air chamber above the reciprocal piston and a second air chamber below the reciprocal piston, the housing further comprising a head plate for closing off an end of the housing opposite the striking plate.

7. The industrial vibrator according to claim 6 wherein the reciprocal piston defines a first air channel in communication with the first housing air chamber and in alternate communication with the pneumatic air inlet and a second air channel in communication with a second housing air chamber and in alternate communication with the pneumatic air inlet so that compressed air entering from the pneumatic air inlet into the first air channel forms an air cushion above the reciprocal piston to drive the reciprocal piston with impact force towards the striking plate thereby allowing the second air channel to be in communication with the pneumatic air inlet so that a second air cushion is formed below the reciprocal piston to drive the piston away from the striking plate.

8. The industrial vibrator according to claim 7 wherein the walls of the housing define two exhaust holes, the first exhaust hole located proximate the head plate and the second exhaust hole located proximate the striking plate so that as the reciprocal piston moves towards and impacts the striking plate, the second exhaust hole is uncovered thereby exhausting the compressed air from the first air chamber.

9. In an impact-type industrial vibrator comprising a housing defining a cylinder bore having closed ends, a reciprocal piston slidably mounted within the bore, the housing further defining at least one compression chamber above the piston, at least one compression chamber below the piston and a pneumatic air inlet for receiving compressed air, the piston defining at least two air channels for receiving compressed air from the housing air chambers, one closed end of the housing forming a striking plate, and an elastomer attached to the end of the piston adjacent the striking plate, the improvement comprising:

the elastomer having a durometer rating between 65 to 75; and the elastomer threaded into the end of the piston adjacent the striking plate.

10. The industrial vibrator according to claim 9 wherein the elastomer comprises a durometer rating of 70.

11. The industrial vibrator according to claim 9 wherein the elastomer comprises a treaded extension and the end of the piston adjacent the striking plate defines a bore reciprocally threaded to receive the threaded extension.

12. An industrial vibrator for imparting vibrations to cause the flow of bulk particulate matter comprising:

a housing comprising cylindrical walls and a striking plate closing off one end of the housing, the cylindrical walls defining a cylindrical bore and at least two exhaust holes, a reciprocal piston within the cylindrical bore, the housing further comprising a pneumatic air inlet for receiving compressed air from a compressed air source, the housing further defining a first air chamber above the piston and a second air chamber above the piston, the housing further comprising a head plate for closing off an end of the housing opposite the striking plate;

the reciprocal piston defining a first air channel in communication with the first housing air chamber and in alternate communication with the pneumatic air inlet and a second air channel in communication with a second housing air chamber and in alternate communication with the pneumatic air inlet so that compressed air entering from the pneumatic air inlet into the first air channel forms an air cushion above the reciprocal piston to drive the reciprocal piston with impact force towards the striking plate thereby allowing the second air channel to be in communication with the pneumatic air inlet so that a second air cushion is formed below the reciprocal piston to drive the piston away from the striking plate;

an elastomeric tip comprising a durometer rating between 65 and 75 and further comprising a treaded extension; and the striking end of the piston defining a bore reciprocally threaded to receive the threaded extension.

* * * * *